US010286433B2

(12) United States Patent
Hill

(10) Patent No.: US 10,286,433 B2
(45) Date of Patent: May 14, 2019

(54) SHIMLESS SPACER

(71) Applicant: Jonathan A. Hill, Clintonville, WI (US)

(72) Inventor: Jonathan A. Hill, Clintonville, WI (US)

(73) Assignee: STEEL KING INDUSTRIES, INC., Stevens Point, WI (US)

( * ) Notice: Subject to any disclaimer, the term of this patent is extended or adjusted under 35 U.S.C. 154(b) by 633 days.

(21) Appl. No.: 15/055,580

(22) Filed: Feb. 27, 2016

(65) Prior Publication Data

US 2017/0246668 A1 Aug. 31, 2017

(51) Int. Cl.
*F16B 43/00* (2006.01)
*B21B 27/02* (2006.01)

(52) U.S. Cl.
CPC ..... *B21B 27/028* (2013.01)

(58) Field of Classification Search
USPC ..... 411/535, 546
See application file for complete search history.

(56) References Cited

U.S. PATENT DOCUMENTS

| | | | | |
|---|---|---|---|---|
| 1,792,122 | A | 2/1931 | Rafter | |
| D198,713 | S | 7/1964 | Curtis | |
| 3,309,117 | A | 3/1967 | Gottschald | |
| 4,008,598 | A | 2/1977 | Purcupile | |
| 4,256,211 | A * | 3/1981 | Katkov | F16D 65/46 188/196 V |
| 4,433,879 | A * | 2/1984 | Morris | F16B 43/009 384/626 |
| 5,060,498 | A | 10/1991 | Seto et al. | |
| 5,090,855 | A * | 2/1992 | Terry | F16B 39/24 29/525.02 |
| 5,175,999 | A | 1/1993 | Hara et al. | |
| D347,567 | S | 6/1994 | Duffy | |
| 5,327,762 | A | 7/1994 | Nagamine et al. | |
| D372,192 | S | 7/1996 | Pigott et al. | |
| 5,599,264 | A | 2/1997 | Hashimoto et al. | |
| D380,959 | S | 7/1997 | Mitchell | |
| 6,176,666 | B1 * | 1/2001 | Osterlund | F16B 5/02 411/535 |
| D633,872 | S | 3/2011 | Shen et al. | |
| D658,973 | S | 5/2012 | Drake | |
| D658,978 | S | 5/2012 | Linares | |
| 8,439,456 | B2 * | 5/2013 | Kiechle | A47L 15/427 312/111 |
| 8,579,572 | B1 | 11/2013 | Psimas | |
| D695,591 | S | 12/2013 | Ackerman et al. | |
| D700,501 | S | 3/2014 | Ackerman et al. | |
| D700,507 | S | 3/2014 | Ackerman et al. | |
| 2011/0318140 | A1 * | 12/2011 | Chang | B62K 21/16 411/535 |
| 2013/0322797 | A1 | 12/2013 | Barth et al. | |

* cited by examiner

*Primary Examiner* — Gary W Estremsky
(74) *Attorney, Agent, or Firm* — Richard John Bartz

(57) ABSTRACT

A spacer for adjusting the width between rollers of roller tooling for machines operable to form metal products has an annular male member with lateral bosses and an annular female member having different depth pockets accommodating the bosses to adjust the combined width of the male and female members.

21 Claims, 19 Drawing Sheets

SHIMLESS SPACER

CROSS REFERENCE TO RELATED APPLICATION

This application is a continuation of U.S. patent application Ser. No. 29/463,135 filed Aug. 12, 2013.

FIELD OF INVENTION

The present invention is in the art of adjustable width spacers for providing width adjustment for roll tooling used in rolling mills to form a metal product. The spacer has male and female members that selectively engage each other to adjust the width of the spacer for adjusting the width of the roll tooling.

BACKGROUND OF THE INVENTION

Rolling machines are used to form sheet metal into channels, angle member and rails. These machines have upper and lower rollers mounted on spindles. The upper rollers have laterally spaced die rolls shaped to correspond to the metal article to be formed. Each time the shape or gauge of the metal article is changed, the die rolls must be replaced or the position of the die rolls on the spindle must be adjusted. Shims between adjacent die rolls are used to provide adjustment to the interval between the die rolls. The die rolls must be removed from the spindle and provide the interval adjustment between the die rolls. The shims are flat annular metal members having different widths. Shims are replaced with different sized shims used to adjust the space between the die rolls. The changing or adjusting of the positions of the die rolls is time consuming and expensive. Examples of structures that functions to adjust the lateral space between die rolls of tooling for rolling mills are described in the following U.S. Patents.

A. Rafter in U.S. Pat. No. 1,792,122 discloses a rolling machine for forming sheet metal into channels. The machine includes spindles rotatably mounted on housings. Rollers mounted on the spindle are shaped to correspond with the article to be formed. One spindle supports two rollers axially separated with C-shaped half sections. The half sections between the rollers can have different lengths to adjust the lateral distance between the two rollers.

Purcupile et al in U.S. Pat. No. 4,008,595 discloses a roll assembly located on an arbor. The roll assembly has a plurality of rolls having annular grooves for engaging and reducing cylindrical rods. Annular spacers interposed between adjacent rolls axially separate adjacent rolls. The width of the spacers is not adjustable.

Seto et al in U.S. Pat. No. 5,060,498 discloses an adjustable roller assembly for straightening H beams. The roller assembly comprises a drive roller and an operation roller. The width between these rollers is adjusted with annular threaded members located between the rollers. A master sleeve nut and a sleeve are detached from a spindle. A roller is then removed from the sleeve. Threaded members are rotated to suitably adjust the position of the straightener roller width to a predetermined width. The roller and threaded member on the sleeve are fitted back on the spindle. The process of the roller width adjustment is labor and time intensive. A motor driven sleeve is also used to adjust the width of a movable rollers relative to a fixed roller without disassembling the apparatus.

Nagamine et al in U.S. Pat. No. 5,327,762 discloses a roller mill with an adjustable roll width for rolling H section metal. The mill includes shaft supporting sleeves. Rolling wheels mounted on the sleeves are adjusted relative to each other by axially moving the sleeves on the shaft. Hydraulic piston and cylinder assemblies operatively connected to the sleeves function to move the sleeves and wheels axially along the shaft to adjust the width between the wheels. Spacers are not used between the wheels.

Hashimoto et al in U.S. Pat. No. 5,599,264 discloses a roller width adjusting device for a divided molding roller used to make a welded pipe. The device has left and right cylindrical tapered rollers mounted on a hollow shaft. One or more spacers a not located on the shaft between the rollers. The adjustment of the width between the rollers is achieved with a threaded shaft accommodating screw members mounted on flanges. Rods connect the flanges to roller holder members. Rotation of the screw members on the threaded shaft axially move the rollers on the shaft to adjust the width between the rollers.

Psimas in U.S. Pat. No. 8,579,572 discloses a load relief washer assembly for threaded fasteners. The washer assembly has an upper member with four two steps extended downwardly from the bottom of the member. Located below the upper member is an annular lower member with four two steps extended inwardly from the top surface of the lower member. The steps on the upper and lower members are complimentary mating surfaces with a plurality of sliding planes. The upper and lower members when rotated relative to each other slide the mating surfaces to adjust the width of the washer assembly.

SUMMARY OF THE INVENTION

The shimless spacer functions to provide width adjustment for roll tooling used in rolling mills without the need to remove the tooling from the rolling mills. There are no pieces to remove or replace. The spacer maintains lateral distance between adjacent tooling rollers and parallel faces of the tooling rollers. The spacer has an annular male member having a plurality of circumferentially spaced bosses extended laterally from one side of the male member. The bosses have rectangular, square or cylindrical configurations with walls extended laterally from the male member. The male annular member engages an annular female member having cavities or pockets accommodating the bosses of the male member to alter the combined width of the male and female members thereby adjusting the width of the spacer.

The spacer comprises an annular male member and an annular female member. The male and female members each have annular circumferential faces providing annular surfaces that are in surface contact to provide the spacer with a first width. The circumferential surfaces are laterally spaced to provide the spacer with a second width greater than a first width. The male member has a plurality of circumferentially spaced bosses projected laterally away from its annular face. The bosses have rectangular or cylindrical shapes. For example, the male member has three bosses with adjacent bosses circumferentially spaced 120 degrees projected laterally away from the annular face of the male member. The bosses each have the same shape and project the same lateral distance away from the annular face. The female member has a plurality of rectangular or cylindrical pockets having ends open to its face. The pockets are circumferentially spaced around the face and extend laterally into the female member. The pockets have shapes that are the same shapes as the bosses which allow the bosses to fit into the pockets. The female member has two times the number of pockets as the number of bosses on the male member. For example, the female member has six circumferentially spaced pockets and the male member has three bosses. The six circumferentially spaced pockets have adjacent pockets circumferentially spaced 60 degrees from each other. The adjacent first and second pockets have different depths with first pockets having depths equal to the lateral distance of the bosses and shapes the same as the shapes of the bosses. The second pockets having depths less than the lateral distance of the bosses and shapes the same as the shapes of the bosses. When the bosses of the male member are located in the first pockets, the faces of the male and female members are in surface engagement whereby the spacer has a first width. When the bosses of the male member are located in the second pockets, the male and female members are laterally spaced from each other whereby the spacer has a second width greater than the first width. The width of the spacer is adjusted by changing the location of the bosses of the male member between the first and second pockets. The adjustment of the male member relative to the female member of the spacer on the spindle of a rolling mill allows the lateral adjustment of the tooling rollers without removing the tooling rollers from the spindle.

DESCRIPTION OF THE ADJUSTABLE WIDTH SPACER

Figure 1:
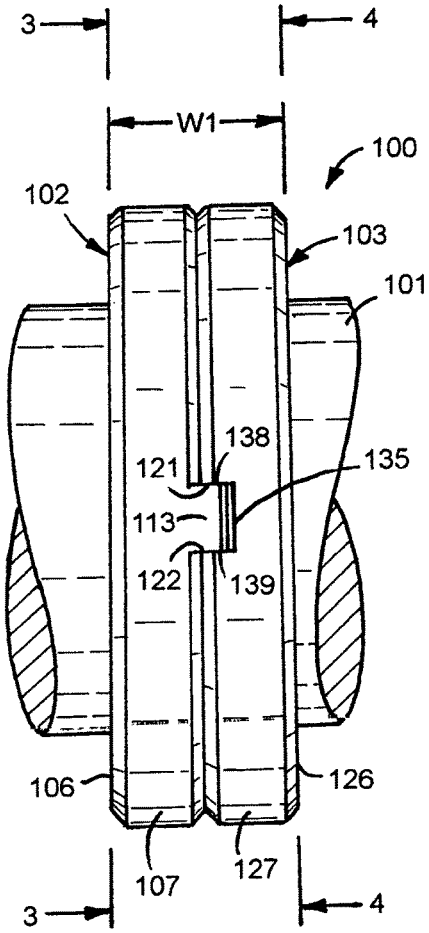
FIG. 1 is a front elevational view of a first embodiment of the adjustable width spacer mounted on a spindle located in a first width position.
Figure 2:
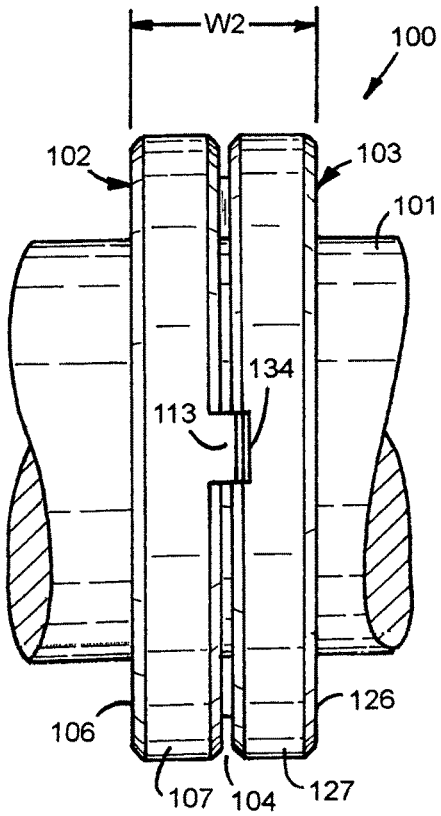
FIG. 2 is a front elevational view of the first embodiment of the adjustable width spacer mounted on the spindle located in a second width position.
Figure 3:
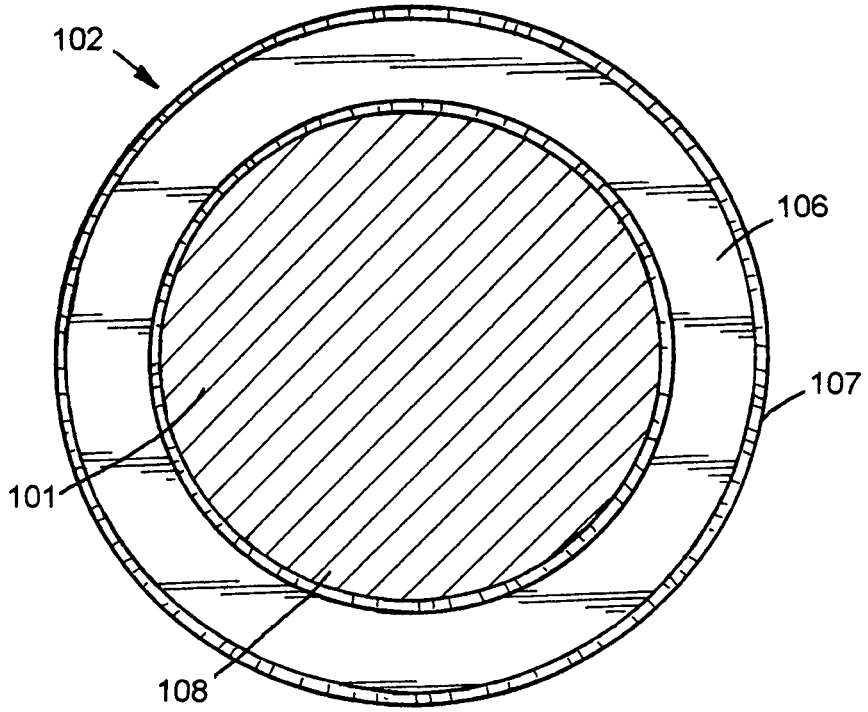
FIG. 3 is a sectional view taken along line 3-3 of FIG. 1.
Figure 4:
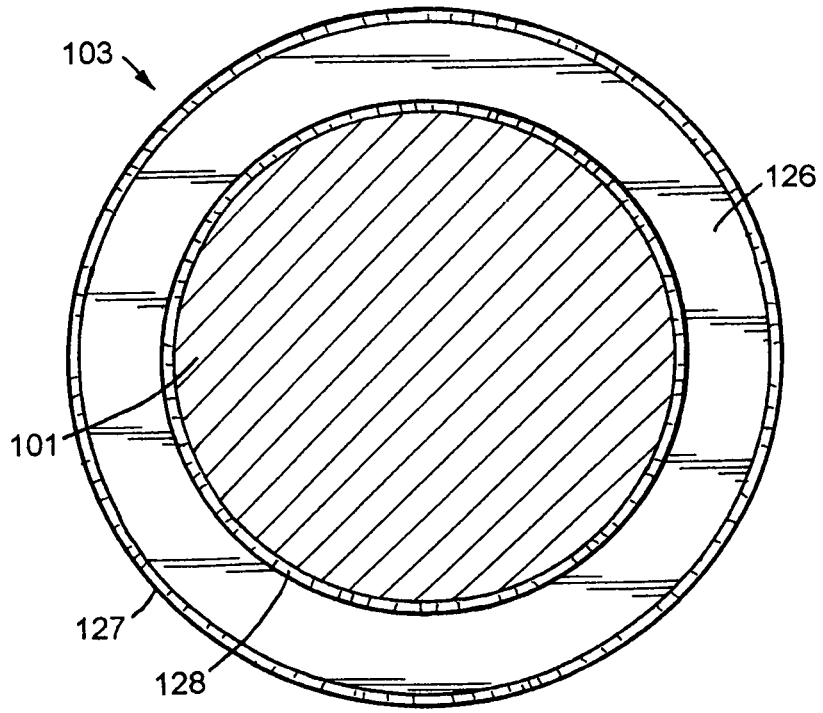
FIG. 4 is a sectional view taken along line 4-4 of FIG. 1.
Figure 5:
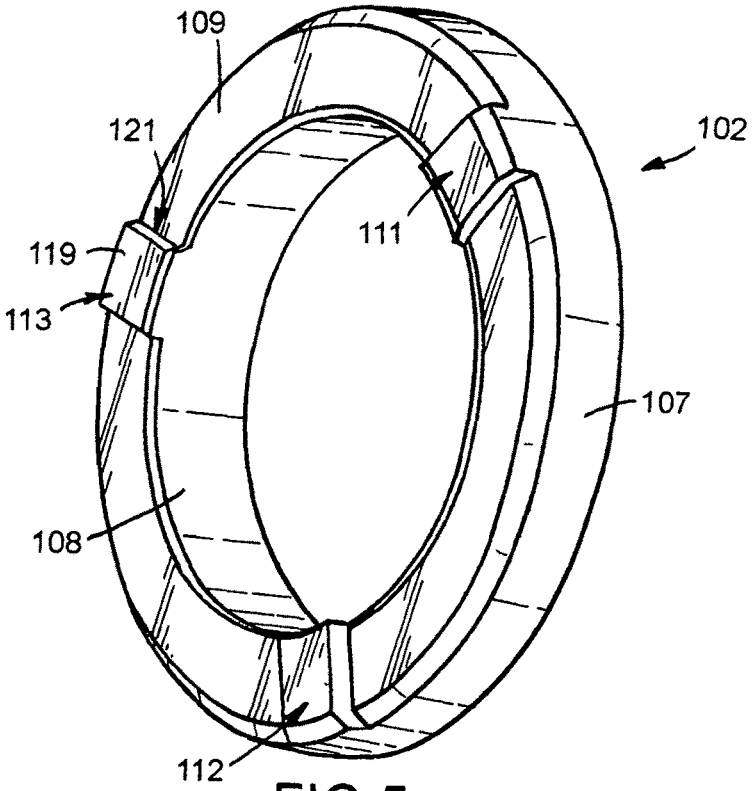
FIG. 5 is a perspective view of the male member of the adjustable width spacer of FIG. 1.

A first embodiment of an adjustable width spacer 100, shown in FIGS. 1 and 2, is mounted on a spindle 101 Spindle 101 is a cylindrical member for tooling of a rolling mill used to form metal products. Examples of rolling mills are disclosed by A. Rafter in U.S. Pat. No. 1,792,122 and T. Seto et al in U.S. Pat. No. 5,060,498. Spacer 100 is used to provide width adjustment of rollers of roll tooling for a rolling mill without the need to remove the tooling from the rolling mill. In use, spacer 100 maintains a fixed lateral distance between adjacent tooling rollers and maintains parallel faces or side walls of the tooling rollers.

Spacer 100 is a two-piece structure comprising an annular male member 102 and an annular female member 130. Male and female members 102 and 103 have the same diameters and are located in a side-by-side surface contact first width position W1 as shown in FIG. 1. Alternatively, male and female members 102 and 103 can be indexed to a side-by-side second width position W2 as shown in FIG. 2. The second width position W2 is wider that the first width position W1 Male and female members 102 and 103 in the first width position W1 are located in face-to-face or surface engagement with each other whereby width W1 is the combined widths of male and female members 102 and 103. There is zero width between male and female members 102 and 103. Male and female members 102 and 103 in the second width position W2 are laterally separated, shown as a lateral distance or space 104, between adjacent faces of male and female members 102 and 103. The space or lateral distance 104 between male and female members 102 and 103 can vary according to requirements of the tooling for a roller mill. For example, space 104 can be a lateral distance of 0.030 inch.

Figure 6:
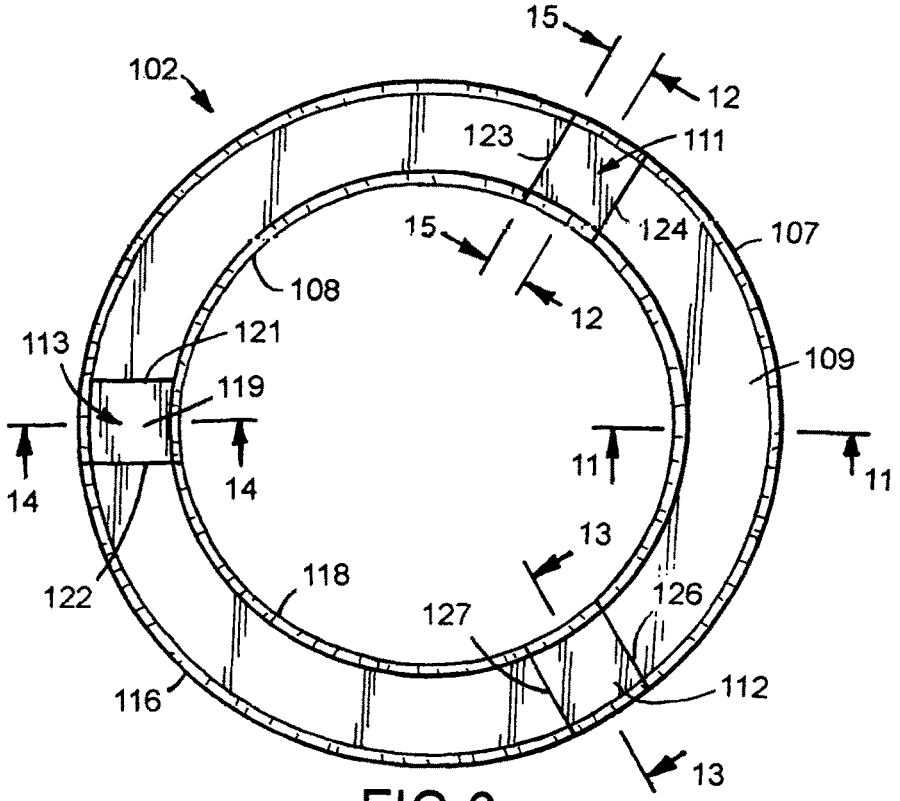
FIG. 6 is a front elevational view of FIG. 5.
Figure 7:
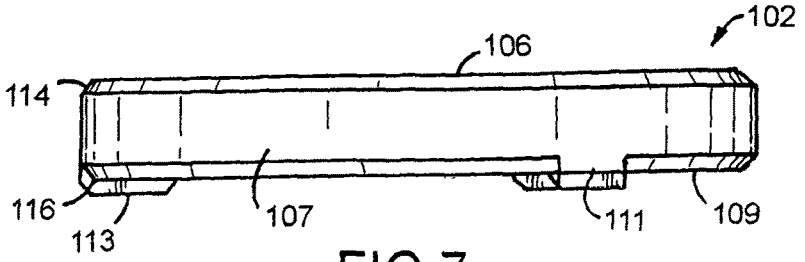
FIG. 7 is a top plan view of FIG. 5.
Figure 8:
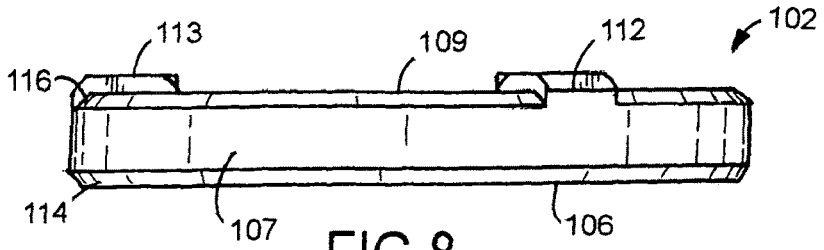
FIG. 8 is a bottom plan view of FIG. 5.
Figure 9:
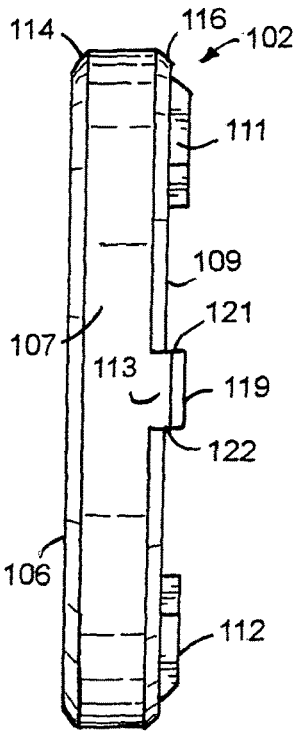
FIG. 9 is a left side elevational view of FIG. 5.
Figure 10:
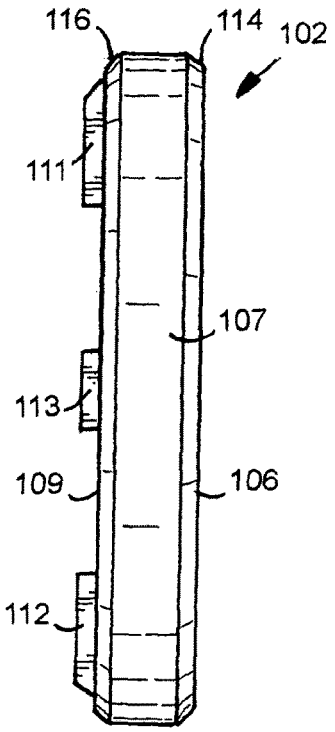
FIG. 10 is a right side elevational view of FIG. 5.
Figure 11:
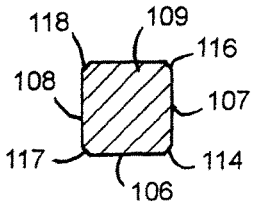
FIG. 11 is a sectional view taken along line 11-11 of FIG. 6.
Figure 12:
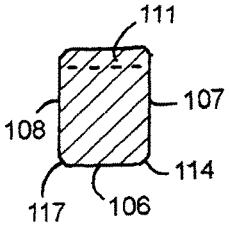
FIG. 12 is a sectional view taken along line 12-12 of FIG. 6.
Figure 13:
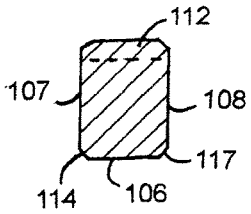
FIG. 13 is a sectional view taken along line 13-13 of FIG. 6.
Figure 14:
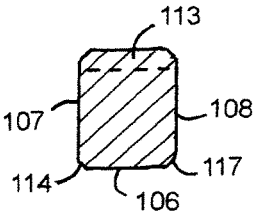
FIG. 14 is a sectional view taken along line 14-14 of FIG. 6.
Figure 15:
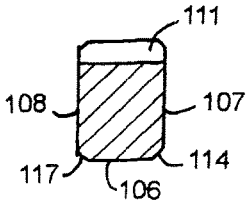
FIG. 15 is a sectional view taken along line 15-15 of FIG. 6.
Figure 16:
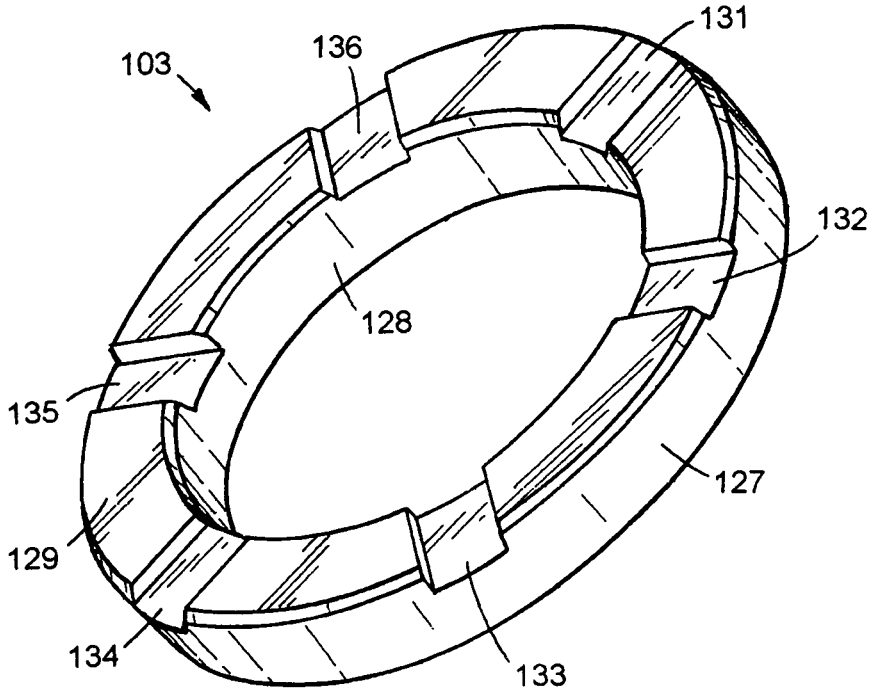
FIG. 16 is a perspective view of the female member of the adjustable width spacer of FIG. 1.

Male member 102, shown in FIGS. 3 and 5 to 10, has an annular flat left side face 106. Face 106 has a circular, flat and continuous surface. The outer peripheral wall 107 has a continuous cylindrical surface. The inner peripheral wall 108 has a continuous cylindrical surface concentric with the cylindrical surface of wall 107. The right side face 109 has three tabs or bosses 111, 112 and 113. As shown in FIG. 6, adjacent bosses are circumferentially spaced 120 degrees from each other. The arcuate segments of face 109 between the adjacent bosses are flat surfaces that are parallel to left face 106. As shown in FIGS. 7 to 10, outer beveled edges 114 and 116 join faces 106 and 109 to wall 107, inner bevel edges 117 and 118 join faces 106, 108 and 109. Boss 113 has a flat top wall 119, shown in FIGS. 5, 6 and 9, and straight, flat and parallel side walls 121 and 122 extended outwardly from face 109. Boss 111 has straight, flat and parallel side walls 123 and 124. Boss 112 also has straight, flat and parallel side walls 126 and 127. Bosses 111, 112 and 113 each have a rectangular configuration extended laterally from face 109, Square or cylindrical shaped bosses can be alternatively joined to face 109.

Figure 17:
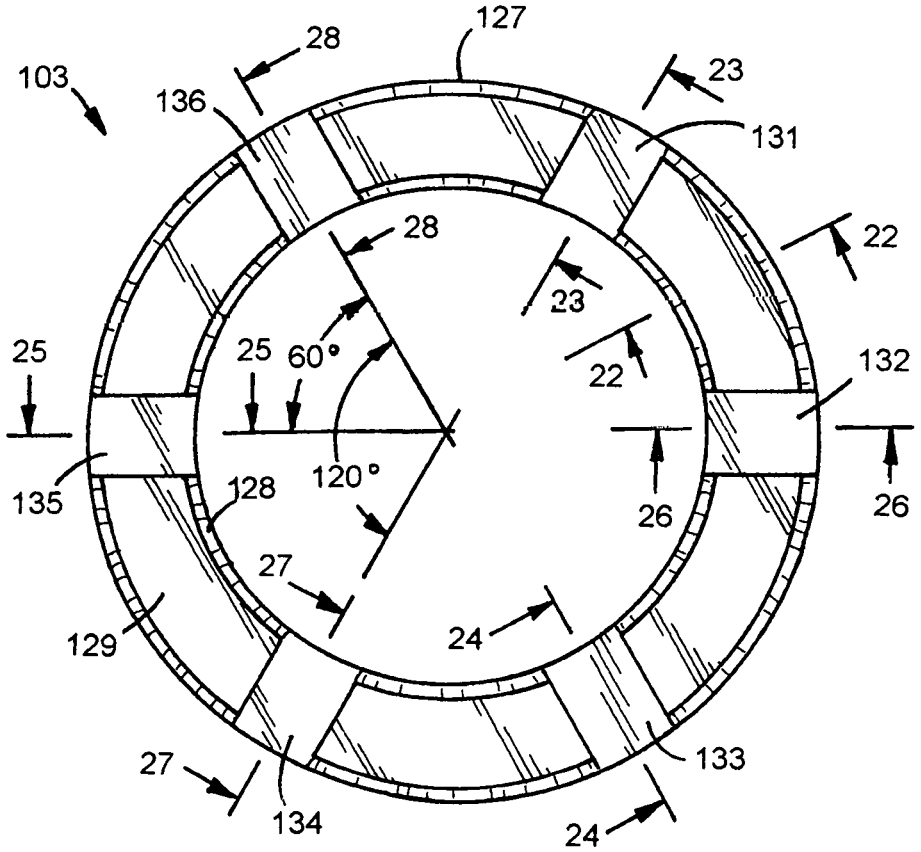
FIG. 17 is a front elevational view of FIG. 16.
Figure 18:
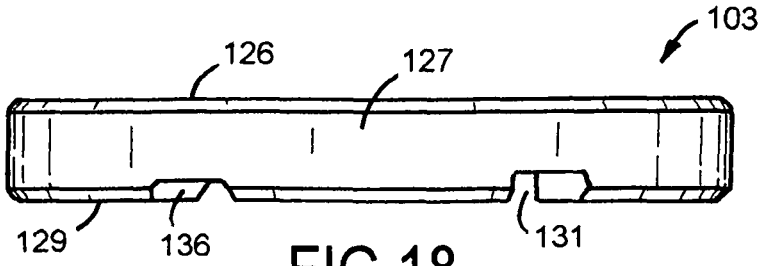
FIG. 18 is a top plan view of FIG. 16.
Figure 19:
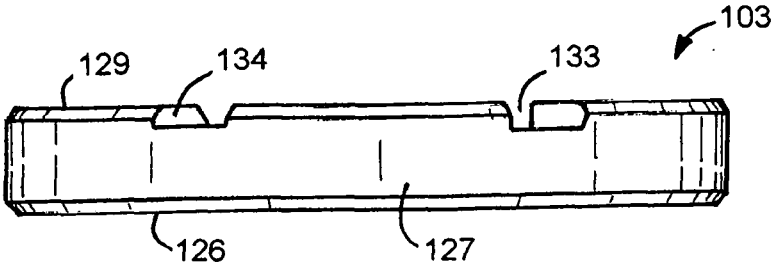
FIG. 19 is a bottom plan view of FIG. 16.
Figure 20:
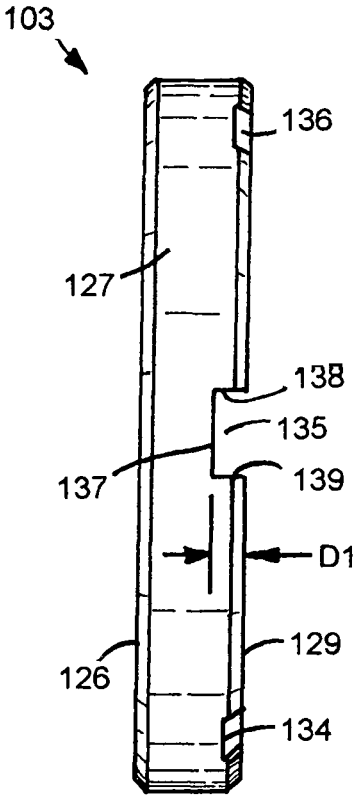
FIG. 20 is a left side elevational view of FIG. 16.
Figure 21:
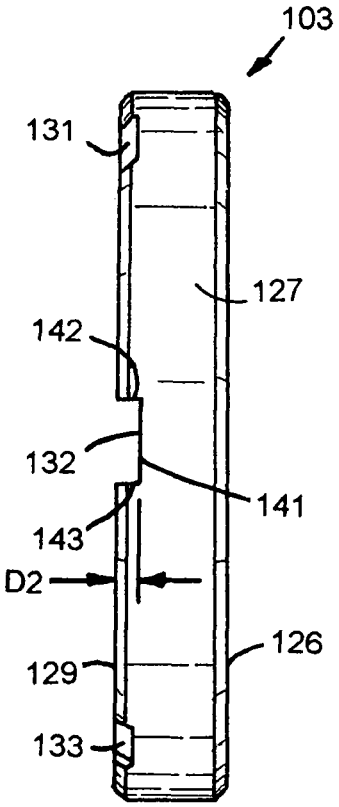
FIG. 21 is a right side elevational view of FIG. 16.
Figure 22:
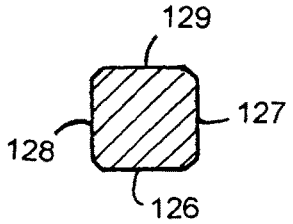
FIG. 22 is a sectional view taken along line 22-22 of FIG. 17.
Figure 23:
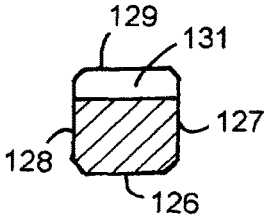
FIG. 23 is a sectional view taken along the line 23-23 of FIG. 17.
Figure 24:
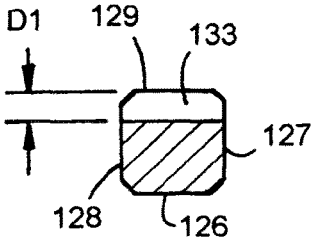
FIG. 24 is a sectional view taken along the line 24-24 of FIG. 17.
Figure 25:
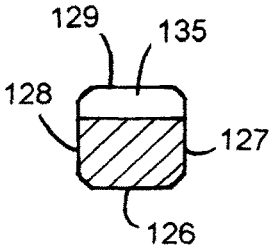
FIG. 25 is a sectional view taken along the line 25-25 of FIG. 17.
Figure 26:
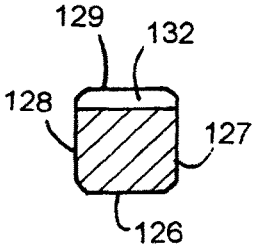
FIG. 26 is a sectional view taken along the line 26-26 of FIG. 17.
Figure 27:
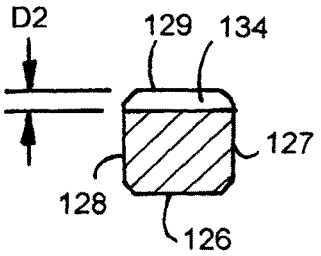
FIG. 27 is a sectional view taken along the line 27-27 of FIG. 17.
Figure 28:
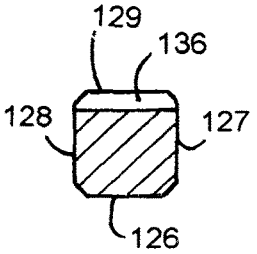
FIG. 28 is a sectional view taken along the line 28-28 of FIG. 17.
Figure 33:
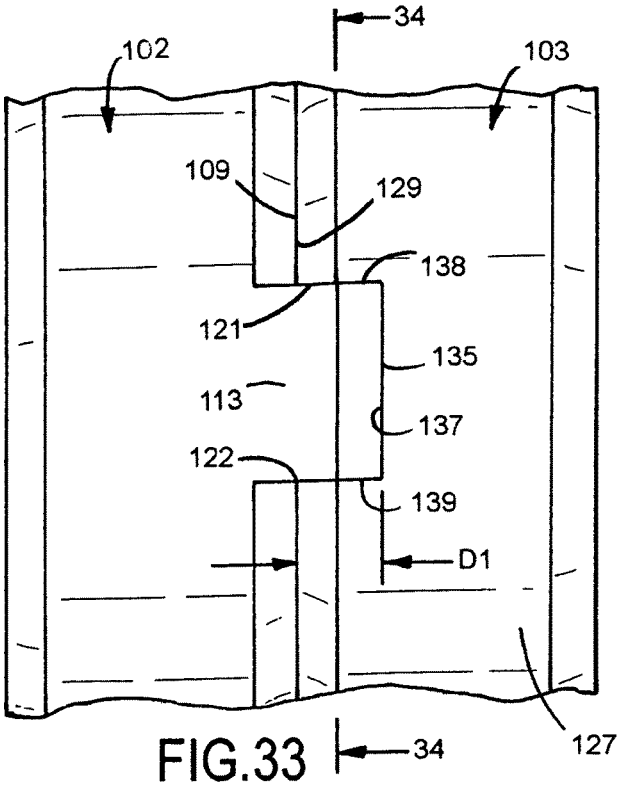
FIG. 33 is an enlarged middle section of FIG. 29.
Figure 34:
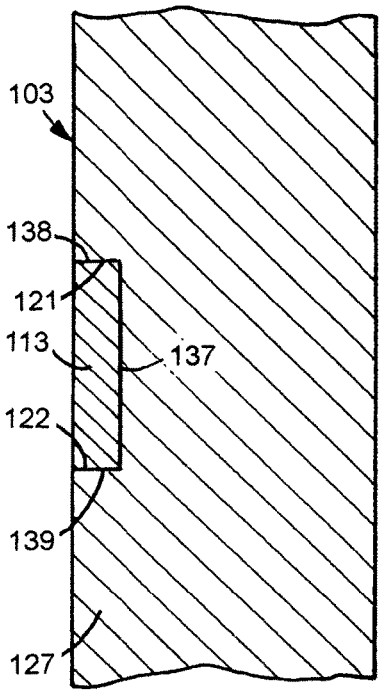
FIG. 34 is a sectional view taken along line 34-34 of FIG. 33.
Figure 35:
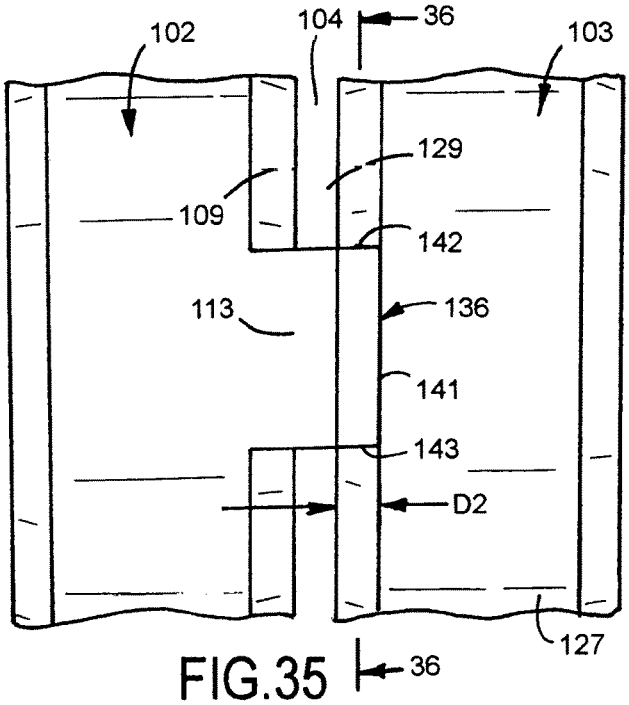
FIG. 35 is an enlarged middle section of FIG. 32.
Figure 36:
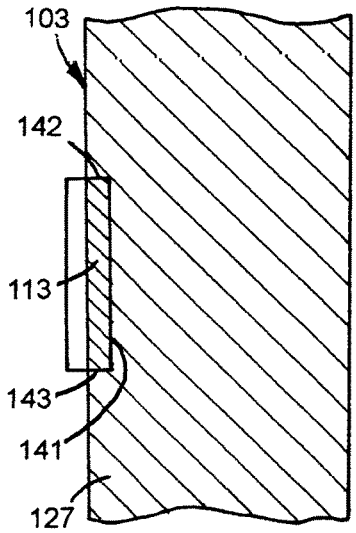
FIG. 36 is a sectional view taken along line 36-36 of FIG. 35.

Female member 103, shown in FIGS. 4 and 16 to 18, has a flat, continuous, annular right face 126, a cylindrical outer peripheral wall 127, an inner peripheral gall 128 and an annular left face 129. Faces 126 and 129 have the same size and circumference as the faces on the male member 102. Peripheral walls 127 and 128 have continuous, concentric and cylindrical surfaces. The right and left faces 126 and 129 are parallel faces. The corners of female member 103 are beveled. As shown in FIGS. 20, 33 and 34, pocket 135 in female member 103 has a flat bottom wall 137 and parallel side walls 138 and 139 providing pocket 135 with a depth D1, Pocket 135 has a rectangular configuration that corresponds to the rectangular configuration and size of boss 113 Pockets 131 and 133 each have the same rectangular configuration and size as pocket 135. As shown in FIGS. 23, 24 and 25, pockets 131, 133 and 135 have the same depth as D1. Adjacent pockets 131, 133 and 135 are spaced 120 degrees from each other. As shown in FIGS. 21, 35 and 36, pocket 132 in female member 103 has a flat bottom wall 141 and parallel side walls 142 and 143 providing pocket 132 with a depth D2. Pocket 132 has a rectangular configuration that corresponds to the rectangular configuration of boss 113 and a depth less than the lateral dimension or width of boss 113. The depth D1 of pocket 132 is one-half the depth D2 of pocket 135. the difference, for example, between depths D1 and D2 is 0.030 inches. As shown in FIGS. 26 to 28, pockets 132, 134 and 136 have the same depth D2. Adjacent pockets 132, 134 and 134, 136 are circumferentially spaced 60 degrees from each other. Pockets 131, 133 and 135 are circumferentially spaced 30 degrees from adjacent pockets 132, 134 and 136 as shown in FIG. 17.

Figure 29:
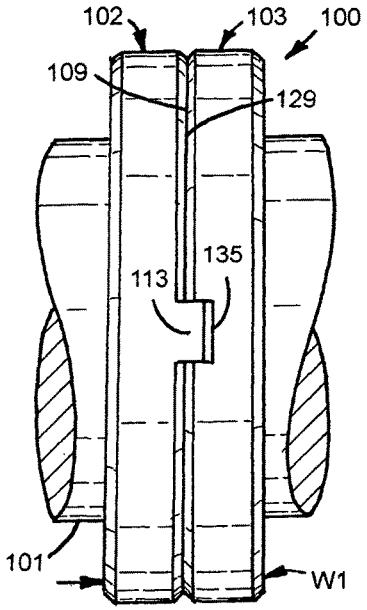
FIG. 29 is a front elevational view of the adjustable width spacer of FIG. 1 in the first width position.
Figure 30:
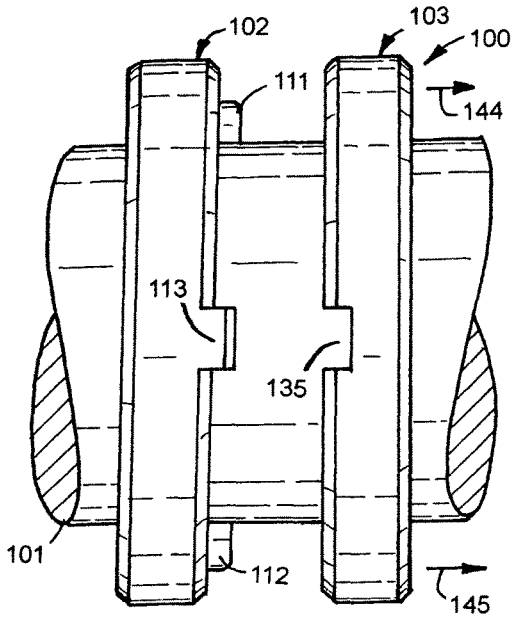
FIG. 30 is a front elevational view of the adjustable width spacer of FIG. 1 showing the female member separated from the male member.
Figure 31:
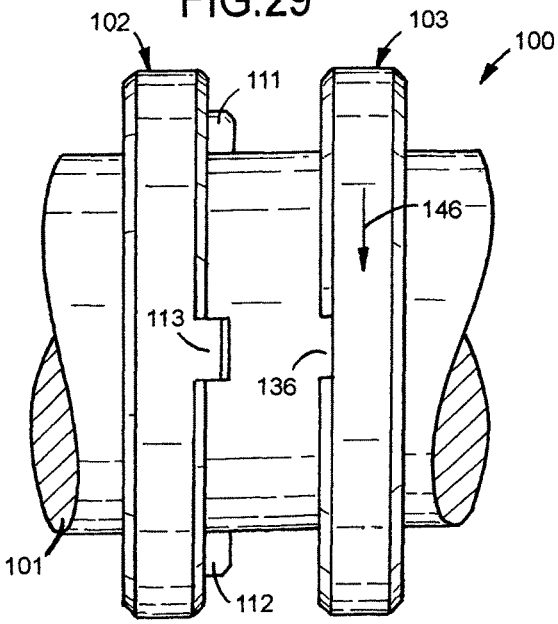
FIG. 31 is a front elevational view of the adjustable width spacer of FIG. 1 showing the female member being rotated to index the female member relative to the male member to the second width position.
Figure 32:
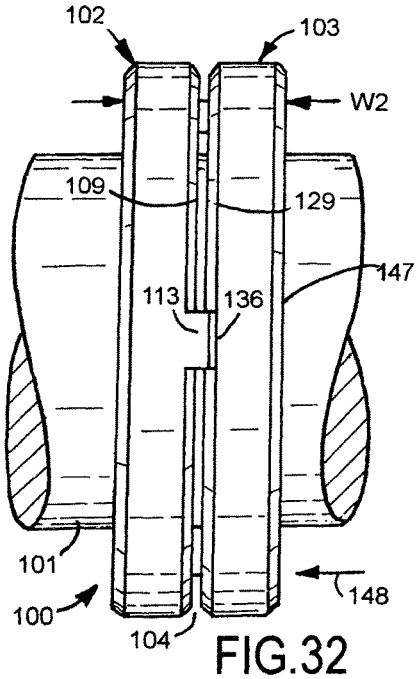
FIG. 32 is a front elevational view of the adjustable width spacer showing the female member moved in spaced relationship relative to the male member in the second width position.

The process of adjusting the width of spacer 100 from the first width position W1 to the second width position W2 is illustrated in FIGS. 29 to 32. Spacer 100 in FIG. 29 is in the first width position W1 with the faces 109 and 129 of male and female members 102 and 103 in side-by-side surface engagement. Boss 113 extends into pocket 135. Bosses 111 and 112 extend into pockets 131 and 133. Each of the bosses 111, 112 and 113 have side walls located in surface engagement with adjacent side walls of pockets 131, 133 and 135 to prevent rotation of male and female members 102 and 103 relative to each other on spindle 101. Male member 102 can be keyed to spindle 101 to inhibit rotation of spacer 100 on spindle 101. As shown in FIG. 30, female member 103 in laterally moved, as shown by arrows 144 and 145, away from male member 102. Bosses 111, 112 and 113 are separated from female member 103. Female member 103 is then turned or rotated 60 degrees, as shown by arrow 146 in FIG. 31, to laterally align pocket 136 with boss 113 and align pockets 132 and 134 with bosses 111 and 112. Female member 103 is then laterally moved, as shown by arrows 147 and 148 in FIG. 32, toward male member 102. Bosses 111, 112 and 113 fit into pockets 132, 134 and 136 whereby bosses 111, 112 and 113 maintain faces 109 and 129 of male and female members 102 and 103 in spaced relationship 104 and spacer 100 in the second width position W2.

Figure 37:
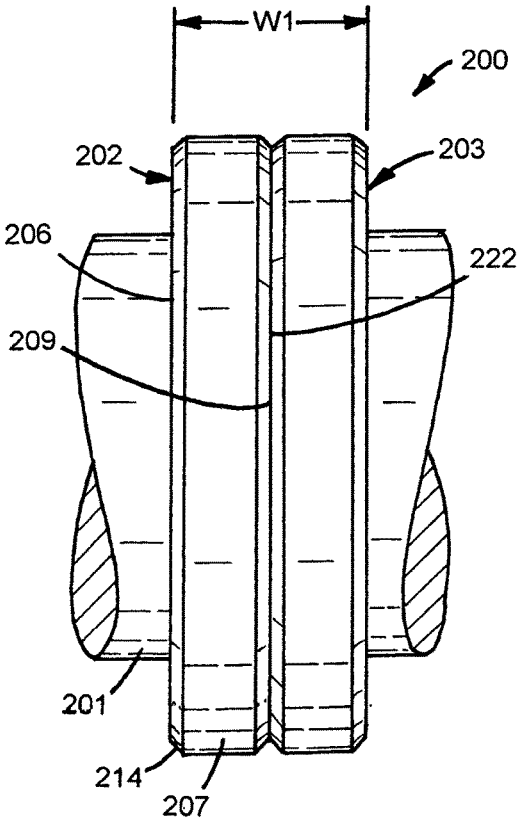
FIG. 37 is a front elevational view of a second embodiment of the adjustable width spacer mounted on a spindle located in a first width position.
Figure 38:
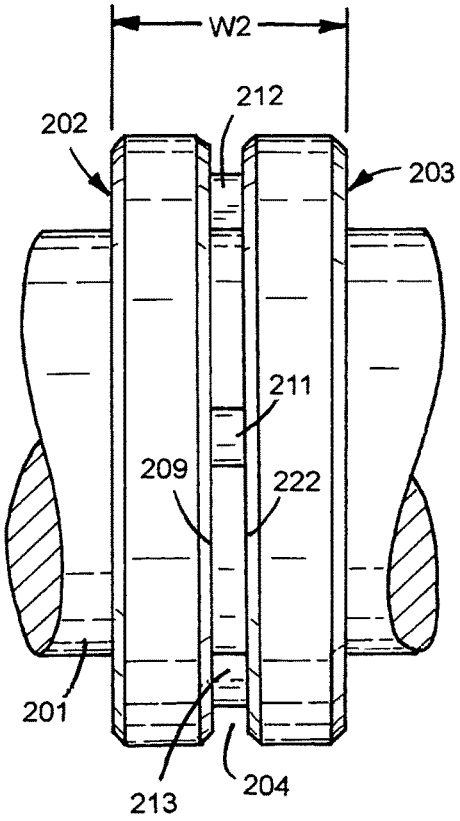
FIG. 38 is a front elevational view of the second embodiment of the adjustable width spacer mounted on the spindle located in a second width position.
Figure 39:
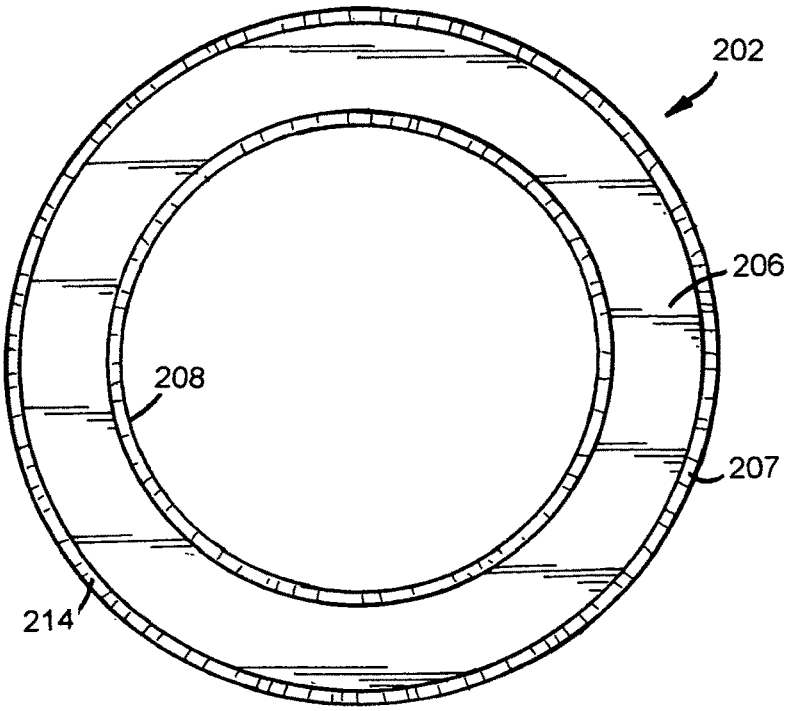
FIG. 39 is a left side devotional view of the male member of FIG. 37.
Figure 40:
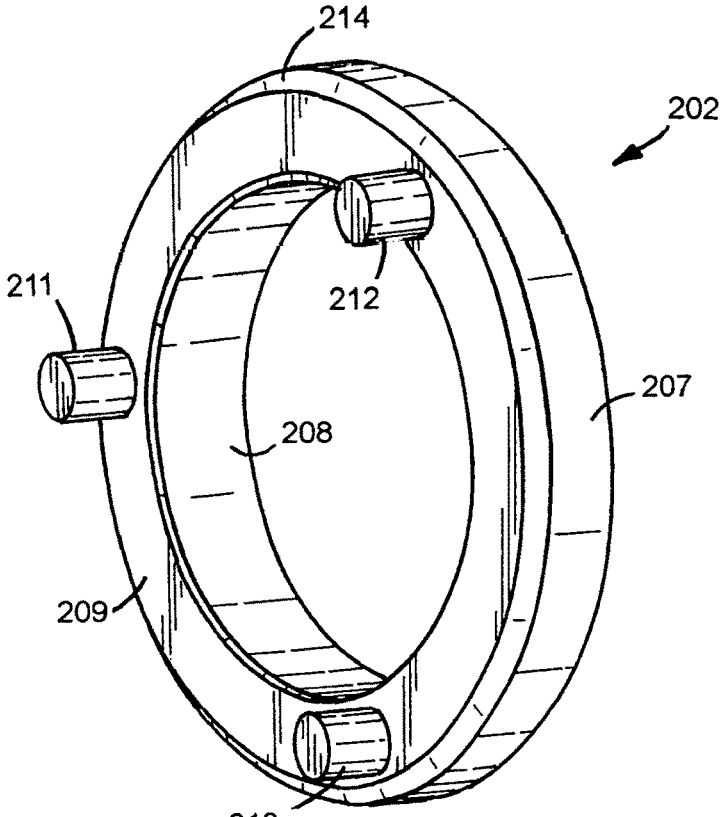
FIG. 40 is a right side perspective view of the male member of the adjustable width spacer of FIG. 37.

A second embodiment of an adjustable spacer 200, shown in FIGS. 37 and 38, is mounted on a spindle 201. Spindle 201 is a cylindrical member of heat-treated alloy steel for tooling of a rolling mill used to form metal products. The cylindrical member can be a shaft or bolt to provide selected lateral distance between members on the shaft or bolt.

Spacer 200 is a two-piece structure comprising an annular male member 202 and an annular female member 203. As shown in FIG. 37, male and female members 202 and 203 are located in a side-by-side surface contact first width position W1. Alternatively, male and female members 202 and 203 can be indexed to a spaced second width position W2 as shown in FIG. 38. The second width position W2 of spacer 200 is wider than its first width position W1. Male and female members 202 and 230 in the first width position W1 are in face-to-face surface engagement whereby width D1 is the combined widths of male and female members 202 and 203. As shown in FIG. 38, male and female members 202 and 230 are laterally separated shown as a lateral space or distance 204 between adjacent faces of male and female members 202 and 203. The space lateral distance between male and female members 202 and 203 can vary. For example, space 204 can be a lateral distance of 0.030 inch.

Figure 41:
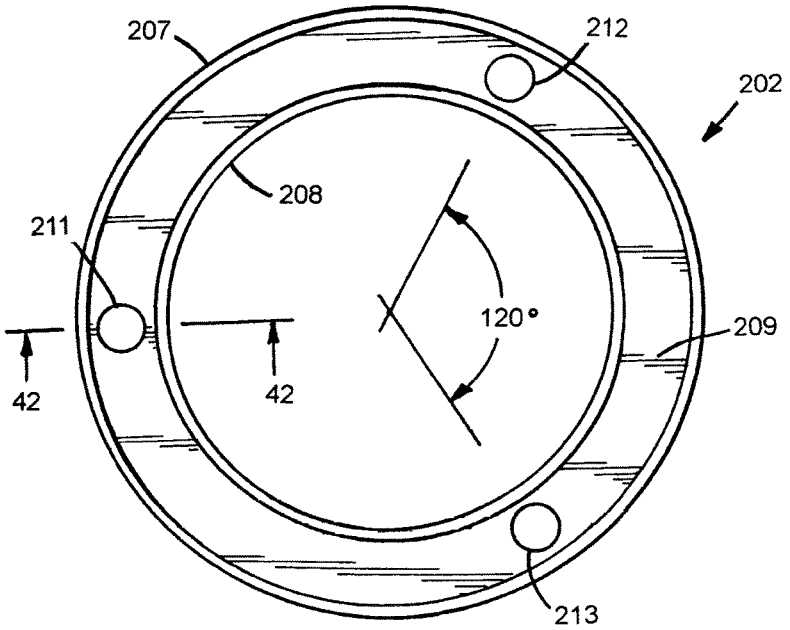
FIG. 41 is a right side elevational view of the male member of the adjustable width spacer of FIG. 37.
Figure 42:
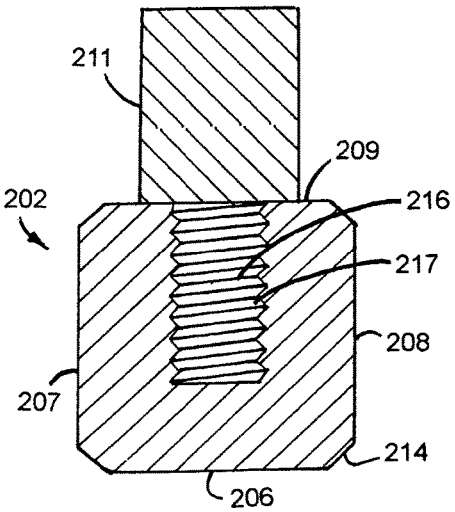
FIG. 42 is an enlarged sectional view taken along line 42-42 of FIG. 41.
Figure 43:
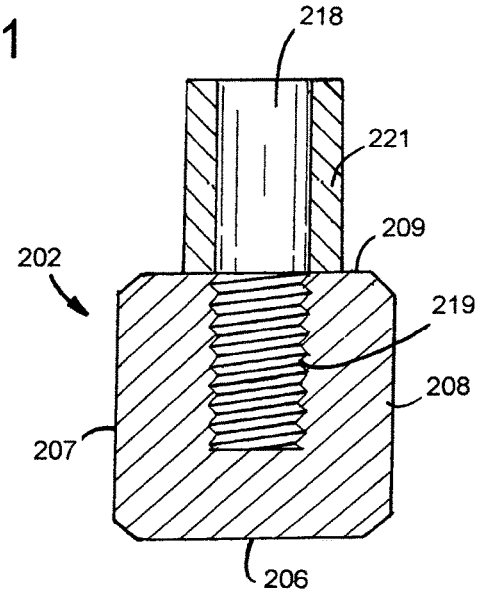
FIG. 43 is a sectional view according to FIG. 42 of a modification of the cylindrical boss mounted on the male ring of the male member of the second embodiment of the adjustable width spacer.
Figure 44:
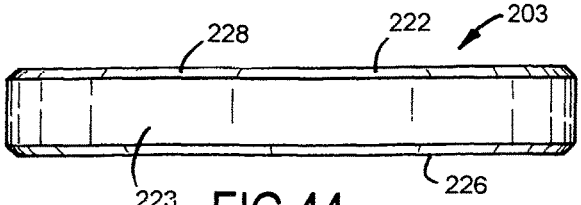
FIG. 44 is a top plan view of the female member of the adjustable width spacer of FIG. 37.
Figure 45:
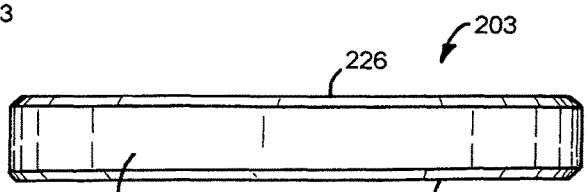
FIG. 45 is a bottom plan view of the female member of the adjustable width spacer of FIG. 37.
Figure 46:
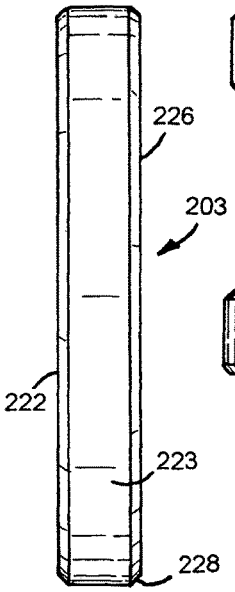
FIG. 46 is a front elevational view of the female member of the adjustable width spacer of FIG. 37.
Figure 47:
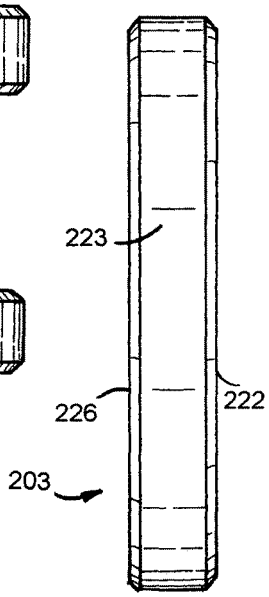
FIG. 47 is a rear elevational view of the female member of the adjustable width spacer of FIG. 37.
Figure 48:
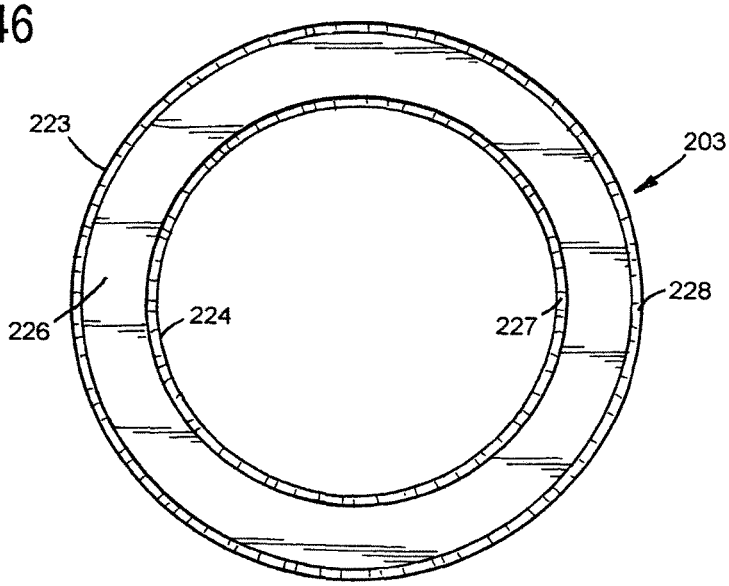
FIG. 48 is a right side elevational view of the female member of the adjustable width spacer of FIG. 37.
Figure 49:
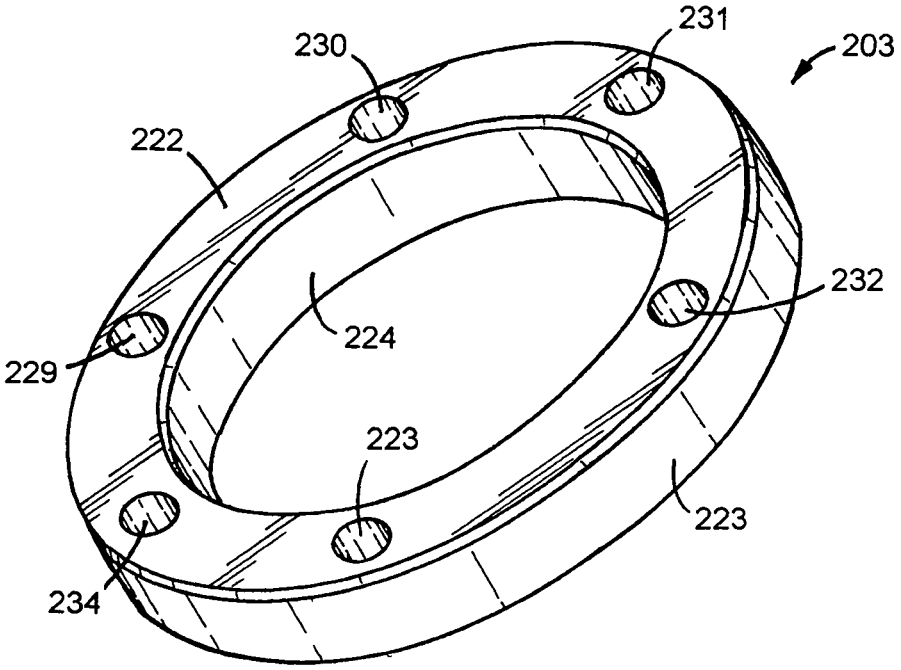
FIG. 49 is a perspective view of the left side of the female member of the adjustable width spacer of FIG. 37.

Male member 202, shown in FIGS. 39 to 43, has an annular flat left side face 206, a continuous cylindrical outer peripheral wall 207 and an inner continuous cylindrical inner peripheral wall 208. Walls 207 and 208 are concentric cylindrical surfaces with beveled corners 214. Male member 202 has a flat right face 209 parallel to left face 206. A plurality of cylindrical bosses 211, 262 and 213 attached to male member 202 project laterally away from right face 209. As shown in FIG. 41, adjacent bosses 212, 213 and 213, 211 are circumferentially spaced 120 degrees from each other. Bosses 211, 212 and 213 have the same diameters and axial lengths. As shown in FIG. 42, boss 211 has a threaded axial stem 216 located in a threaded hole 217 in the body of male member 202. Stem 216 allows boss 211 to be removed from male member 202 and replaced with another boss. Bosses 212 and 213 have threaded stems located in threaded holes in the body of male member 203 according to FIG. 42. An alternative connection of a boss to the ring of male member 202, shown in FIG. 43, has a pin or cylindrical member 218 threaded into a threaded hole 219 in male member 202 Pin 218 projects laterally away from face 109. A sleeve or cylindrical bushing 221 is located around the outer end of pin 218. Bushing 221 has an outer diameter and axial length that is the same as the diameter and axial length of boss 211. The diameter size and length of the boss 211 and bushing 221 can vary.

Figure 50:
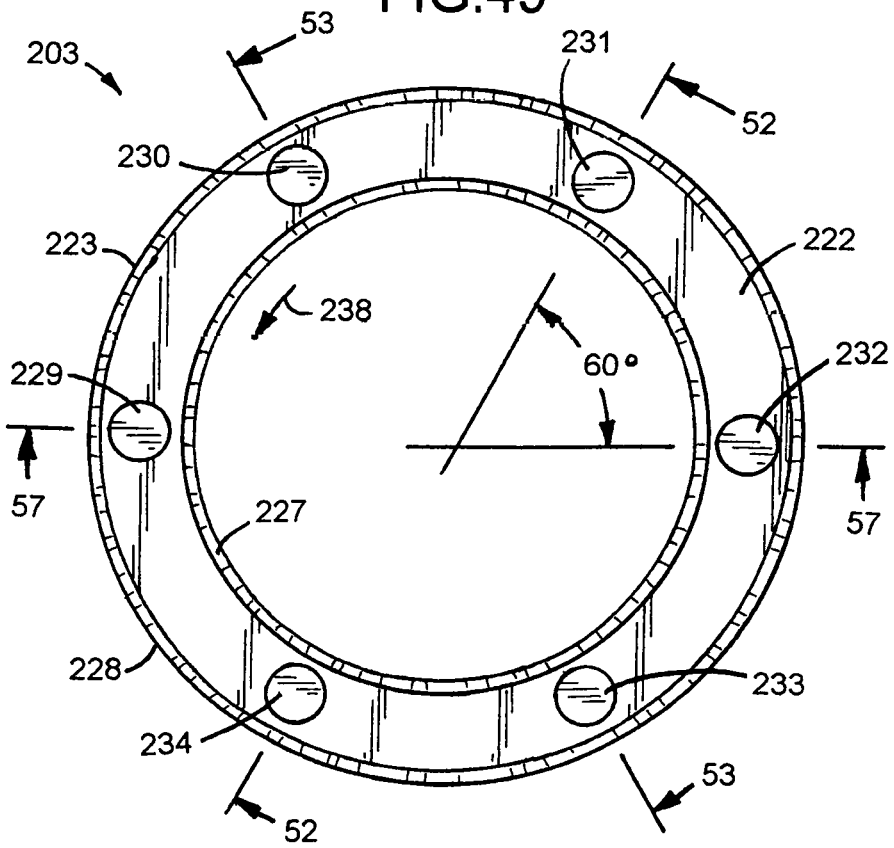
FIG. 50 is a left side elevational view of the female member of the adjustable width spacer of FIG. 37.
Figure 51:
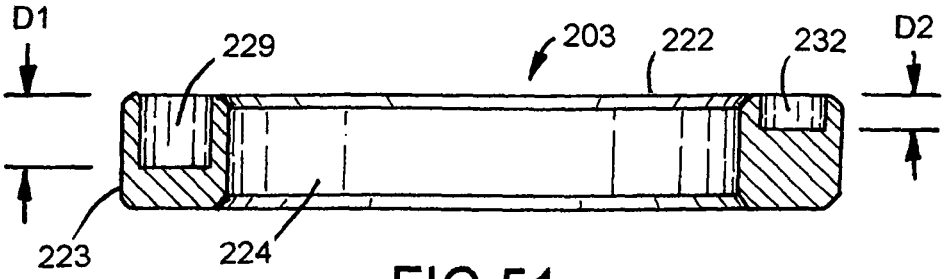
FIG. 51 is a sectional view taken along line 51-51 of FIG. 50.
Figure 52:
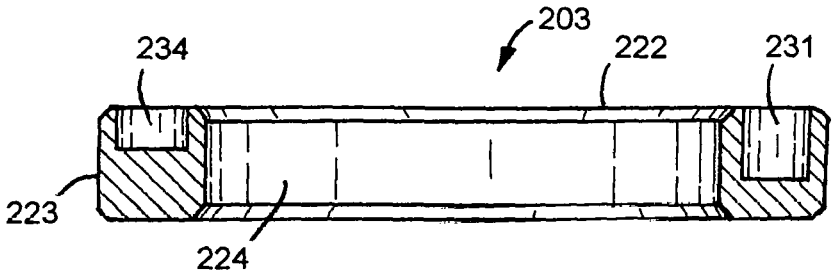
FIG. 52 is a sectional view taken along line 52-52 of FIG. 50.
Figure 53:
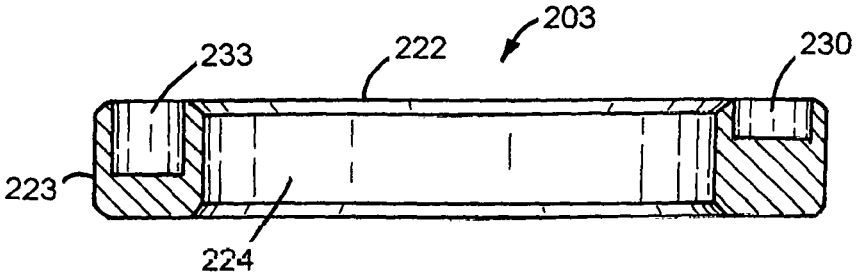
FIG. 53 is a sectional view taken along line 53-53 of FIG. 50.
Figure 58:
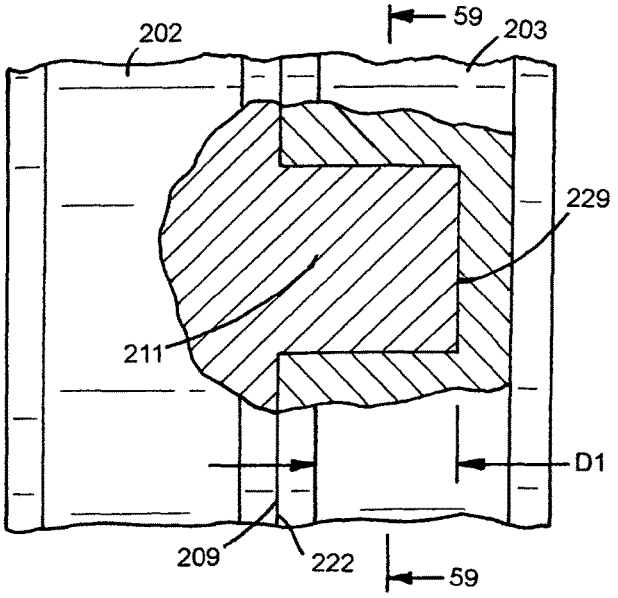
FIG. 58 is an enlarged middle se ion partly sectioned of FIG. 54.
Figure 59:
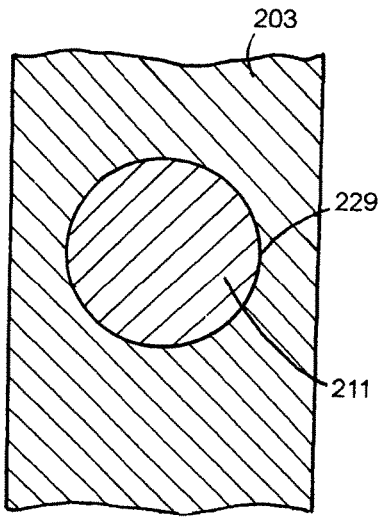
FIG. 59 is a sectional view taken along line 59-59 of FIG. 58.
Figure 60:
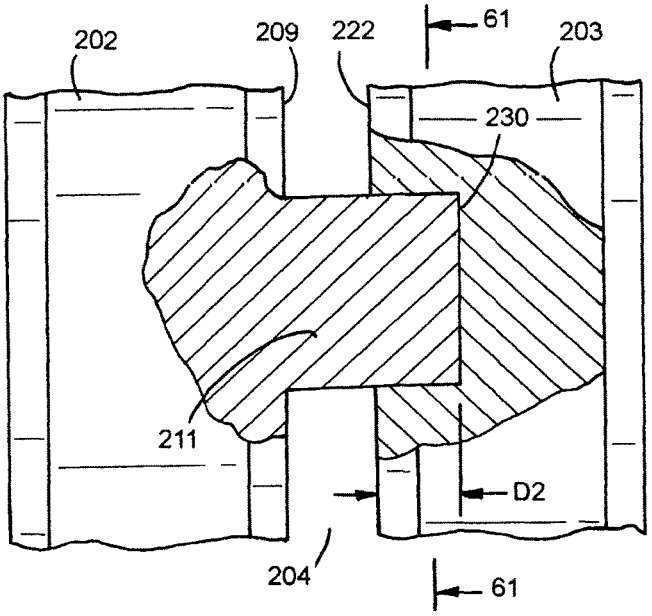
FIG. 60 is an enlarged middle section partly sectioned of FIG. 57.
Figure 61:
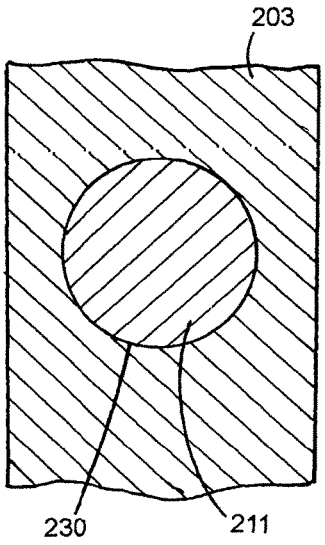
FIG. 61 is a sectional view taken along line 61-61 of FIG. 60.

Female member 203, shown in FIGS. 44 to 53, has a continuous flat annular left face 222, an outer cylindrical peripheral wall 223, and an inner cylindrical peripheral wall 224. Walls 223 and 225 are concentric cylindrical surfaces between left face 222 and right face 226. Faces 222 and 226 have bevel inner and outer edges 227 and 228. Faces 222 and 226 have flat annular surfaces that are parallel to each other whereby female member 203 has a uniform width. Female member 203 has a plurality of cavities or pockets 229, 230, 231, 232, 233 and 234 extended inwardly from face 222. The six pockets 229-234 are open to face 222 with adjacent pockets circumferentially spaced from each other as shown in FIG. 50. Pockets 229-234 diameters corresponding to the diameters of bosses 211, 212 and 213 to allow bosses 211, 212 and 213 to fit into the pockets with engaging or contact relationship with the cylindrical walls of pockets 229-234. As shown in FIGS. 51, 52 and 53, pockets 229, 231 and 233 extend into the body of female member 203 a distance D1. Distance D1 is substantially the same as the length of a boss 211. Pockets 230, 232 and 234 extend into the body of female member 203 a distance D2. Distance D2 is less than distance D1. As shown in FIG. 51, distance D2 is one-half the distance D1. The difference between distance D2 and D1 can be 0.030 inch. Female member 203 can have additional pockets located between adjacent pockets 229-234 having selected depths to provide additional width adjustment of spacer 200. As shown in FIGS. 58 and 59. When boss 211 is located in pocket 229, the adjacent faces 209 and 222 of male and female members 202 and 203 are in side-by-side surface contact whereby the first width position of spacer 200 is the combined widths of male and female members 202 and 203. The bosses 211, 212 and 213 in pockets 229, 231 and 233 lock spacer 200 in its first width position W1 and prevent rotation of female member 203 relative to male member 202. As shown in FIGS. 60 and 61, when boss 211 is located in pocket 230, the adjacent faces 209 and 222 of male and female members 202 and 203 are laterally spaced from each other. Boss 211 extended into pocket 230 prevents female member 203 from engaging male member 202 and maintains the second width position W2. Bosses 211, 212 and 213 located in pockets 230, 232 and 234 lock female member 203 onto male member 202 and prevent rotation of female member 203 relative to male member 202.

Figure 54:
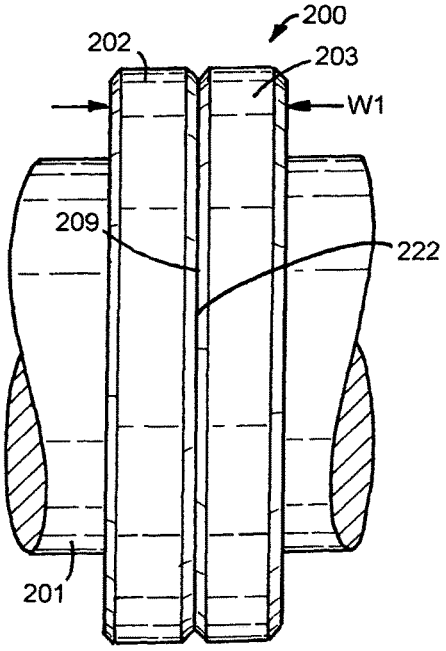
FIG. 54 is a front elevational view of the adjustable width spacer of FIG. 37 in the first width position.
Figure 55:
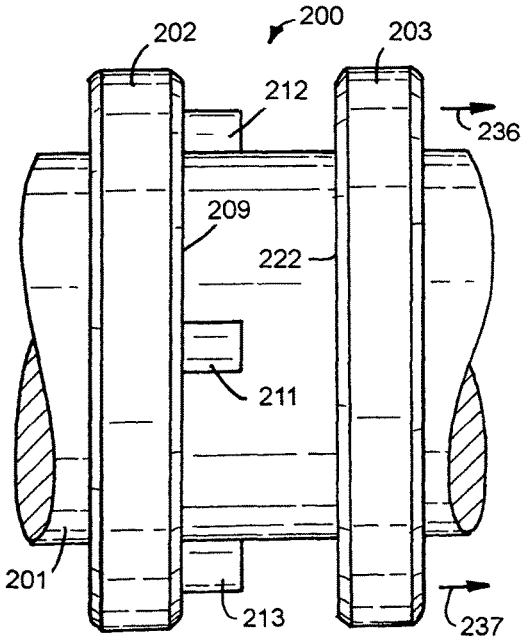
FIG. 55 is a front elevational view of the adjustable width spacer of FIG. 37 showing the female member separated from the male member.
Figure 56:
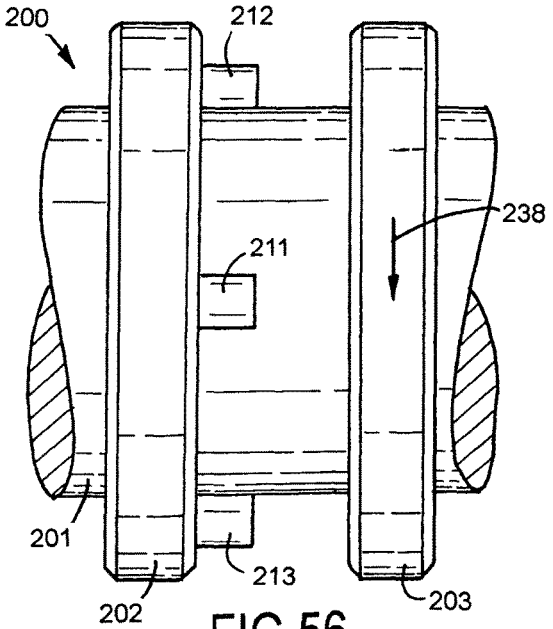
FIG. 56 is a front elevational view of the adjustable width spacer of FIG. 37 showing the female member being rotated relative to the male member to index the female member to the second width position.
Figure 57:
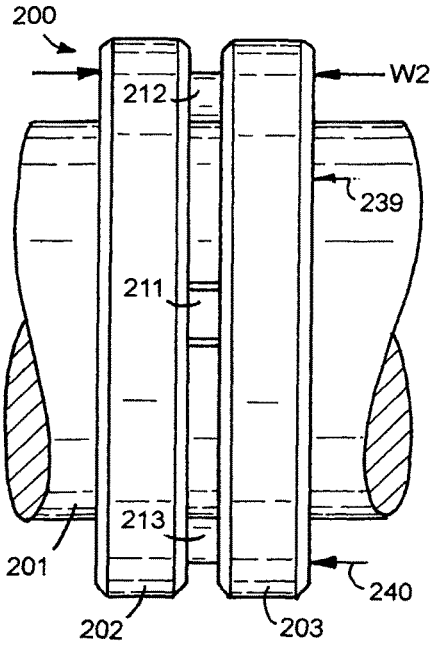
FIG. 57 is a front elevational view of the adjustable width spacer of FIG. 37 in the second width position.

The process of adjusting the width of spacer 200 from the first width position W1 to the second width position W2 is illustrated in FIGS. 54 to 57. Spacer 200 in FIG. 54 is in the first width position W1 with faces 209 and 222 of male and female members 202 and 203 in side-by-side surface engagement. The first width position W1 of spacer 200 is the combined widths of male and female members 202 and 203. Bosses 211, 212 and 213 located in pockets 229, 231 and 223 maintain lateral alignment of male and female members 202 and 203 and prevent rotation of female member 203 relative to male member 202. As shown in FIG. 55, female member 203 is laterally moved, as shown by arrows 236 and 237 away from male member 202. Bosses 211, and 213 are separated from female member 203. Female member 203 is then turned or rotated 60 degrees, as shown by arrow 238, to laterally align pockets 233, 231 and 229 with bosses 211, 212 and 213. Female member 203 is then laterally moved, as shown by arrows 239 and 240 in FIG. 57, toward male member 202 and locating bosses 211, 212 and 213 in pockets 233, 231 and 229. Bosses 211, 212 and 213 maintain male and female members 202 and 203 in spaced relationship 204 and spacer 200 in the second width position W2.

Figure 62:
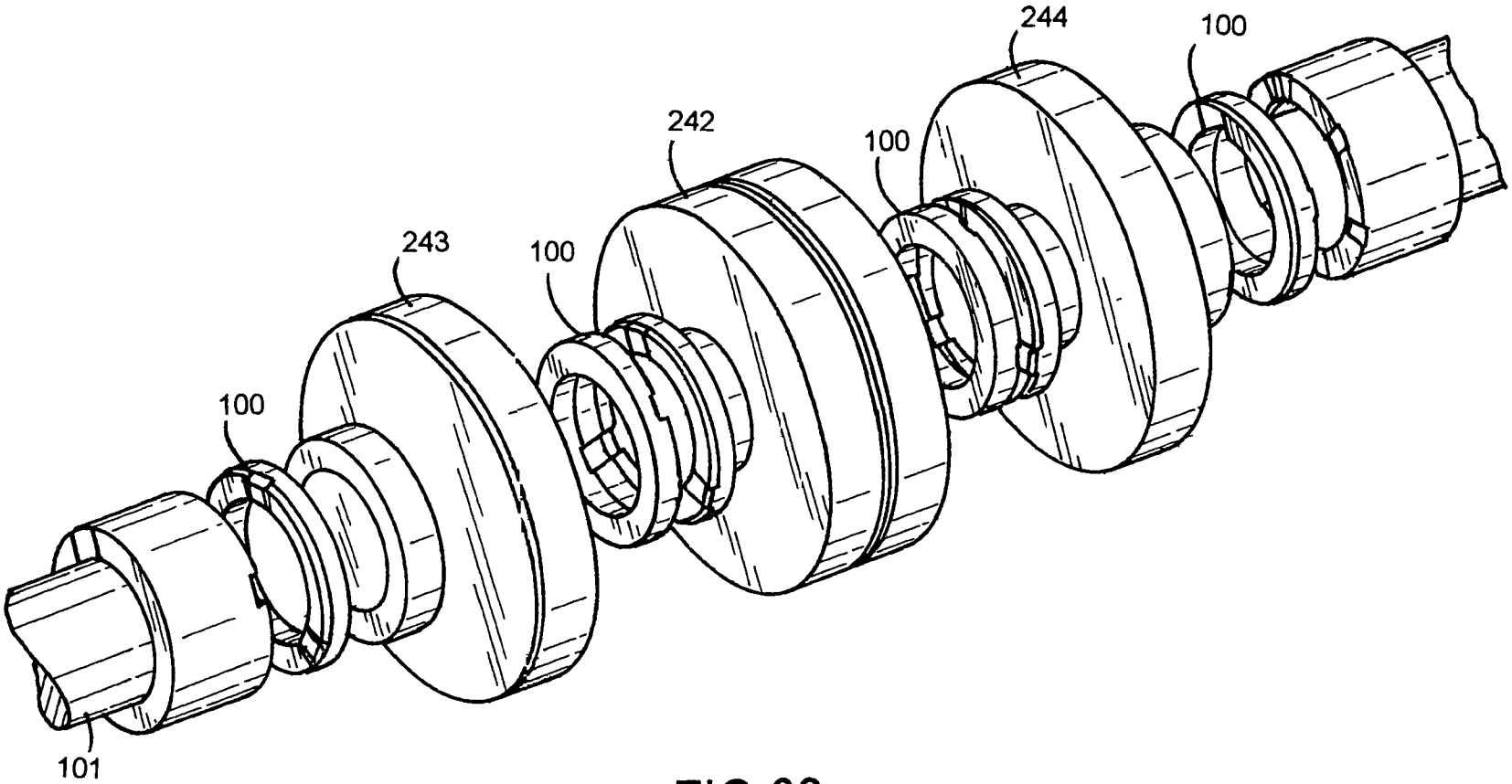
FIG. 62 is an exploded perspective view of roller mill tooling including adjustable width spacers of the invention.

An example of tooling 241 for a rolling mill, shown in FIG. 62, includes adjustable width spacers 100 on spindle 101 located between a middle roller 242 and side rollers 243 and 244. Spacers 100 are used to adjust the lateral locations of side rollers 243 and 244 relative to middle roller 242 to adjust the tooling according to the gauge of a metal product Preferred embodiments of the adjustable width spacer for roller mill tooling has been described and illustrated in the drawing. Modifications and uses of the adjustable width spacer to persons skilled in the art are included in the invention without departing from the scope of the invention as defined in the following claims.

The invention claimed is:

1. An adjustable width spacer comprising:

an annular male member, said annular male member having an annular first side face and an annular flat second side face opposite the first side face, a continuous cylindrical outer surface, a continuous cylindrical inner surface, said inner surface being concentric with the outer surface, three bosses joined to the second side face of the annular male member, adjacent bosses being circumferentially spaced 120 degrees from each other, each boss having a lateral length extended away from the second side face of the annular male member, the bosses having the same lateral length and flat end surfaces parallel to the flat second side face of the annular male member, an annular female member, said annular female member having an annular first side face and an annular flat second side face, a continuous cylindrical outer surface, a continuous cylindrical inner surface, said annular female member including side walls open to the second side face of the annular female member and bottom walls parallel to the flat second side face of the annular female member providing six pockets extended from the second side face of the annular female member laterally into the annular female member, adjacent pockets being circumferentially spaced 60 degrees from each other, said six pockets comprise three first pockets circumferentially spaced 120 degrees apart and open to the second side face of the annular female member and three second pockets circumferentially spaced 120 degrees apart and open to the second side face of the annular female member, each of the first pockets having a first depth corresponding to the lateral length of a boss whereby when the bosses are located in the first pockets, the flat end surfaces of the bosses are located in surface engagement with the bottom walls of the first pockets and the second side faces of the male and female members are in surface engagement whereby the combined male and female members have a first width, each of the second pockets having a flat bottom wall and a second depth, said second depth being less than the lateral length of a boss whereby when the bosses are located in the second pockets, the flat end surfaces of the bosses are located in surface engagement with the flat bottom walls of the second pockets and the second side faces of the male and female members are spaced apart and the combined male and female members have a second combined width greater than the first width of the combined male and female members.

2. The spacer of claim 1 wherein:

the bosses have rectangular configurations, and the pockets have rectangular configurations corresponding to the rectangular configuration of the bosses.

3. The spacer of claim 1 wherein:

the bosses have side walls, and the side walls of the pockets engage the side walls of the bosses.

4. An adjustable width spacer comprising:

an annular male member, said annular male member having an annular circumferential first side face and an annular circumferential second side face opposite the first side face, a continuous cylindrical outer surface, a continuous cylindrical inner surface, said inner surface being concentric with the outer surface, three bosses joined to the second side face of the annular male member, adjacent bosses being circumferentially spaced 120 degrees from each other and each boss having a length projected laterally away from the second side face of the annular male member, the bosses are cylindrical members, an annular female member, said annular female member having an annular circumferential first side face and an annular circumferential second side face, a continuous cylindrical outer surface, a continuous cylindrical inner surface, six pockets extended from the second side face of the annular female member laterally into the annular female member, adjacent pockets being circumferentially spaced 60 degrees from each other, the pockets are cylindrical walls providing holes in the female member for accommodating the cylindrical members, said six pockets comprise three first pockets circumferentially spaced 120 degrees apart and open to the second side face of the annular female member and three second pockets circumferentially spaced 120 degrees apart and open to the second side face of the annular female member, each of the first pockets having a first depth corresponding to the lengths of the bosses whereby when the bosses are located in the first pockets, the second side faces of the male and female members are in surface engagement and the combined male and female members have a first width, each of the second pockets having a second depth, said second depth being less than the first depth of the first pockets whereby when the bosses are located in the second pockets, the second side faces of the male and female members are spaced apart and the combined male and female members have a second combined width greater than the first width of the combined male and female members.

5. The spacer of claim 4 wherein:

each boss includes a stem threaded into the male member for connecting the boss to the male member, and a cylindrical bushing mounted on the stem.

6. An adjustable width spacer comprising an annular male member, said annular male member having an annular flat male first face, an annular flat second face, said male second face being parallel to the male first face, a continuous cylindrical outer surface, a continuous cylindrical inner surface, said inner cylindrical surface being concentric with the outer cylindrical surface, a plurality of circumferentially spaced bosses joined to the flat second face, each of said bosses having a lateral length extended away from the flat second face, the bosses having the same lateral length and flat end surfaces parallel to the flat second face of the male member, an annular female member having an annular flat first face, an annular flat second face, a continuous cylindrical female outer cylindrical surface, a continuous cylindrical female inner cylindrical surface, said female inner cylindrical surface being concentric with the female outer cylindrical surface, said female member including side walls open to the flat second face and bottom walls parallel to the second flat face of the female member providing a plurality of pockets extended from the second face of the female member laterally into the female member, said pockets include a first number of pockets circumferentially spaced around the second face of the female member, each of said first number of pockets having a first depth equal to the lateral length of a boss and a second number of pockets circumferentially located between adjacent the first number of pockets, each of said second number of pockets having a second depth, said second depth being less than the first depth, whereby the annular male and female members have a combined first width when the bosses are located in the first number of pockets and the flat second surfaces of the male and female members are in surface engagement and a second combined width greater than the first width when the bosses are located in the second number of pockets and the flat second surfaces of the male and female members are spaced apart from each other.

7. The spacer of claim 6 wherein:

the bosses have rectangular configurations, and the pockets have rectangular configurations corresponding to the rectangular configuration of the bosses.

8. The spacer of claim 6 wherein:

the bosses have side walls, and the side walls of the pockets engage the side walls of the bosses.

9. An adjustable width spacer comprising:

an annular male member, said annular male member having an annular flat male first face, an annular male second face, said male second face being parallel to the male first face, a continuous cylindrical outer surface, a continuous cylindrical inner surface, said inner cylindrical surface being concentric with the outer cylindrical surface, a plurality of circumferentially spaced bosses joined to the second face, each of said bosses projected laterally from the second face, the bosses are cylindrical members, an annular female member having an annular flat female first face, an annular flat female second face, said female second face being parallel to the female first face, a continuous cylindrical female outer cylindrical surface, a continuous cylindrical female inner cylindrical surface, said female inner cylindrical surface being concentric with the female outer cylindrical surface, a plurality of pockets extended from the female second face laterally into the female member, the pockets are cylindrical walls providing holes in the female member for accommodating the cylindrical members, said pockets including a first number of pockets circumferentially spaced around the female second face, each of said first number of pockets having a first depth and a second number of pockets circumferentially located between adjacent the first number of pockets, each of said second number of pockets having a second depth, said second depth being less than the first depth, whereby the annular male and female members have a combined first width when the bosses are located in the first number of pockets and a second combined width greater than the first width when the bosses are located in the second number of pockets.

10. The spacer of claim 9 wherein:

each boss includes a stem threaded into the male member for connecting the boss to the male member, and a cylindrical bushing mounted on the stem.

11. An adjustable width spacer comprising an annular male member, said annular male member having an annular first face, and an annular flat second face, a plurality of circumferentially spaced bosses joined to the flat second face, each of said bosses having a lateral length extended away from the flat second face, the bosses having the same lateral length, an annular female member having an annular first face, and an annular flat second face, said female member including side walls open to the flat second face of the female member providing a plurality of pockets extended from the flat second face of the female member laterally into the female member, said pockets include a first number of pockets circumferentially spaced around the second face of the female member, each of said first number of pockets having a first depth corresponding to the lateral length of a boss and a second number of pockets circumferentially located between adjacent the first number of pockets, each of said second number of pockets having a second depth, said second depth being less than the first depth, whereby the annular male and female members have a combined first width when the bosses are located in the first number of pockets and the second faces of the male and female members are in surface engagement and a second combined width greater than the first width when the bosses are located in the second number of pockets and the second faces of the male and female members are spaced from each other.

12. The spacer of claim 11 wherein:

the bosses have rectangular configurations, and the pockets have rectangular configurations corresponding to the rectangular configuration of the bosses.

13. The spacer of claim 11 wherein:

the bosses have parallel side walls, and the side walls of the female member engage the bosses.

14. An adjustable width spacer comprising:

an annular male member, said annular male member having an annular male first face, an annular male second face, said male second face being parallel to the male first face, a plurality of circumferentially spaced bosses joined to the second face, each of said bosses projected laterally from the second face, the bosses are cylindrical members, an annular female member having an annular female first face, an annular female second face, said female second face being parallel to the female first face, a plurality of pockets extended from the female second face laterally into the female member, the pockets are cylindrical walls providing holes in the female member for accommodating the cylindrical members, said pockets including a first number of pockets circumferentially spaced around the female second face, each of said first number of pockets having a first depth and a second number of pockets circumferentially located between adjacent the first number of pockets, each of said second number of pockets having a second depth, said second depth being less than the first depth, whereby the annular male and female members have a combined first width when the bosses are located in the first number of pockets and a second combined width greater than the first width when the bosses are located in the second number of pockets.

15. The spacer of claim 14 wherein:

each boss includes a stem threaded into the male member for connecting the boss to the male member, and a cylindrical bushing mounted on the stem.

16. The spacer of claim 14 wherein:

the first number of pockets each have a first depth equal to the length of a boss on the male member whereby when the bosses of the male member are located in the first number of pockets, the first side face of the male member is in surface engagement with the second side face of the female member thereby locating the male and female members in a first width position.

17. The spacer of claim 14 wherein:

the first side face is a first annular face, the plurality of bosses of the male member comprise three bosses circumferentially spaced 120 degrees apart on the first annular face, the second side face is a second annular face, the plurality of pockets of the female member comprise three first number of pockets circumferentially spaced 120 degrees apart open to the second annular face and three second number of pockets circumferentially spaced 120 degrees apart open to the second annular face and adjacent first and second number of pockets being circumferentially spaced 60 degrees from each other.

18. An adjustable width spacer comprising:

a male member, said male member having a first side face and a plurality of bosses projected laterally away from the first side face, the bosses are cylindrical members, a female member, said female member having a second side face and a plurality of pockets projected from the second side face into the female member, the pockets are cylindrical walls providing holes in the female member for accommodating the cylindrical members, said pockets including a first number of pockets, each of said first number of pockets having a first depth and a second number of pockets, each of said second number of pockets having a second depth, said second depth of the second number of pockets being less than the first depth of the first number of pockets whereby the male and female members have a combined first width when the bosses are located in the first number of pockets and a second combined width greater than the combined first width of the male and female members when the bosses are located in the second number of pockets.

19. The spacer of claim 18 wherein:

each boss includes a stem threaded into the male member for connecting the boss to the male member, and a cylindrical bushing mounted on the stem.

20. The spacer of claim 18 wherein:

the first number of pockets each having a first depth equal to the length of a boss on the male member whereby when the bosses of the male member are located in the first number of pockets the first side face of the male member is in surface engagement with the second side face of the female member thereby locating the male and female members in a first width position.

21. The spacer of claim 18 wherein:

the first side face is a first annular face, the plurality of bosses of the male member comprises three bosses circumferentially spaced 120 degrees apart on the first annular face, the second side face is a second annular face, the plurality of pockets of the female member comprise three first number of pockets circumferentially spaced 120 degrees apart open to the second annular face and three second number of pockets circumferentially spaced 120 degrees apart open to the second annular faces and adjacent first and second number of pockets having circumferentially spaced 60 degrees from each other.

* * * * *